United States Patent [19]

Sherman

[11] Patent Number: 4,997,184

[45] Date of Patent: Mar. 5, 1991

[54] TRAVEL DUMBBELL

[76] Inventor: Barry S. Sherman, 1473 Halekoa Dr., Waialae, Hi. 96821-1550

[21] Appl. No.: 495,998

[22] Filed: Mar. 20, 1990

[51] Int. Cl.[5] ..... A63B 27/072

[52] U.S. Cl. ..... 272/122

[58] Field of Search ..... 272/117, 119, 122, 123, 272/124; D21/196, 197

[56] References Cited

U.S. PATENT DOCUMENTS

| | | | |
|---|---|---|---|
| D. 271,408 | 11/1983 | Bauer | D21/197 |
| 2,644,890 | 7/1953 | Hollihan | 272/122 |
| 3,231,270 | 1/1966 | Winer | D21/197 X |
| 4,720,098 | 1/1988 | Gordon | 272/143 |
| 4,905,992 | 3/1990 | McWain | 272/123 |

*Primary Examiner*—Robert Bahr
*Assistant Examiner*—D'Michéle Berryman
*Attorney, Agent, or Firm*—Michael I. Kroll

[57] ABSTRACT

A travel dumbbell is provided and consists of two end plates positioned between at least one water fillable weight on each end of an elongated bar for support and stabilization. A collar is removably mounted on each end of the bar to retain the end plates and the at least one water fillable weight on each end of the bar. A carrying case is also provided and sized to receive at least one disassembled travel dumbbell therein.

8 Claims, 3 Drawing Sheets

TRAVEL DUMBBELL

BACKGROUND OF THE INVENTION

1. Field of the Invention

The instant invention relates generally to hand held exercise devices and more specifically it relates to a travel dumbbell.

2. Description of the Prior Art

Numerous hand held exercise devices have been provided in prior art that are adapted to be disassembled for storage and transport. While these units may be suitable for the particular purpose to which they address, they would not be as suitable for the purposes of the present invention as heretofore described.

SUMMARY OF THE INVENTION

A primary object of the present invention is to provide a travel dumbbell that will overcome the shortcomings of the prior art devices.

Another object is to provide a travel dumbbell that includes a plurality of water fillable weights which are filled with water when used and are collapsible by emptying them for storage and transport.

An additional object is to provide a travel dumbbell that includes a plurality of end plates each with a plurality of flat edges in which the end plates support the water fillable weights and the flat edges prevent the dumbbell from rolling on a floor.

A further object is to provide a travel dumbbell that is simple and easy to use.

A still further object is to provide a travel dumbbell that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
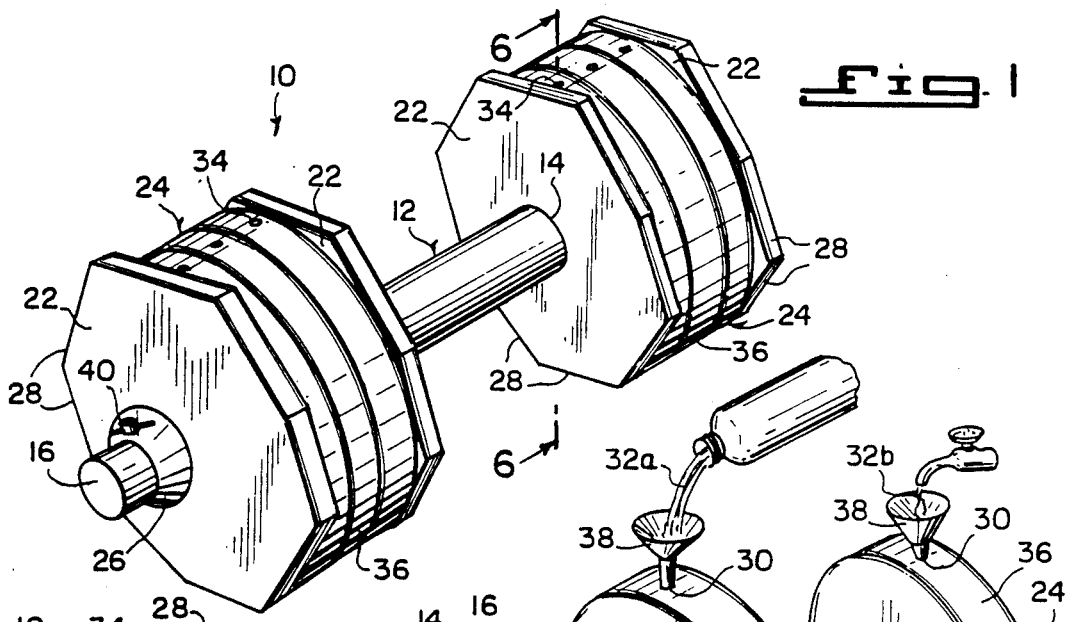
FIG. 1 is a perspective view of the invention.
Figure 2:
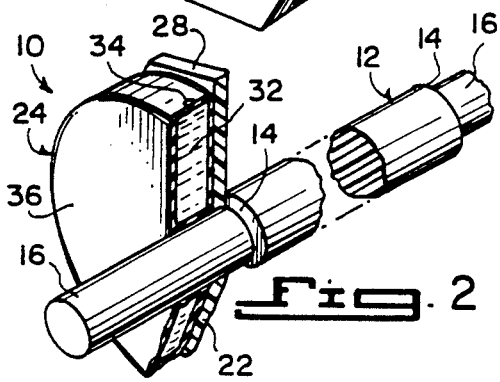
FIG. 2 is a perspective view of the invention with parts removed, broken away and in section.

Turning now descriptively to the drawings, in which similar reference characters denote similar elements throughout the several views, the Figures illustrate a travel dumbbell 10 consisting of an elongated bar 12 having two abutments 14, each spaced inwardly from one end 16 thereof. The elongated bar 12 is to be gripped by at least one hand 18 of a user 20. Four end plates 22 and a plurality of water fillable weights 24 are also provided.

One end plate 22 is removable mounted on each end 16 of the bar 12 against one abutment 14. At least one water fillable weight 24 is removably mounted on each end 16 of the bar 12 against one end plate 22. A remaining end plate 22 is then removably mounted on each end 16 of the bar 12. At least one water fillable weight 24 will be positioned between two end plates 22 on each end 16 of the bar 12 for support and stabilization.

Two collars 26 are also provided in which one is removably mounted on each end 16 of the bar 12 to retain the end plates 22 and the at least one water fillable weight 24 on each end 16 of the bar 12.

Figure 10:
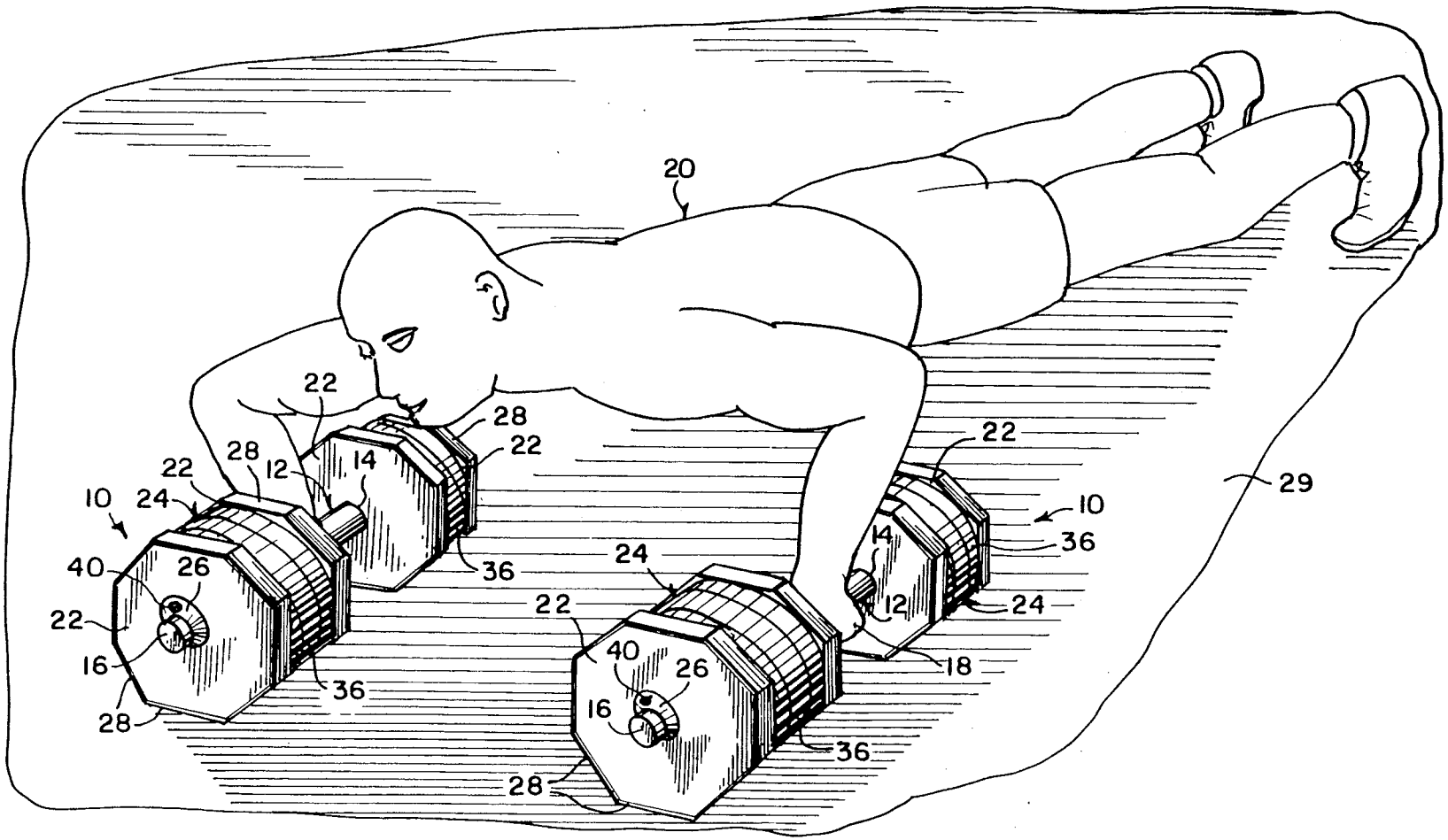
FIG. 10 is a perspective view of two travel dumbbells being used for a push up exercise.

Each end plate 22 is slightly larger in diameter than each of the water fillable weights 24 and further includes a plurality of flat edges 28 around its periphery. The flat edges 28 will prevent the water fillable weights 24 from rolling along a floor 29, such as, when the user 20 utilizing two travel dumbbells 10 for a push up exercise (see FIG. 10).

Each water fillable weight 24 has an opening 30 to receive water 32 therein and a closure plug 34 for sealing the opening 30. The water 32 can be added to the water fillable weight 24 when being used and removed therefrom for storage and transport. Each water fillable weight 24 is fabricated out of a rubber donut shaped enclosure 36 so that the enclosure can be collapsible when the water 32 is removed therefrom.

Figures 3, 4:
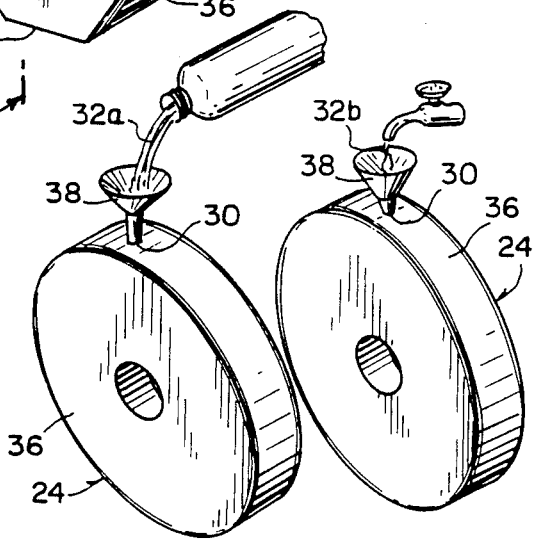
FIG. 3 is a perspective view of one of the water fillable weights being filled with bottled water.
FIG. 4 is a perspective view of one of the water fillable weights being filled with tap water.
Figure 5:
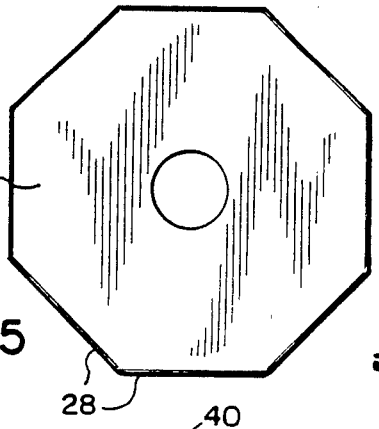
FIG. 5 is an end view of one of the end plates.
Figure 6:
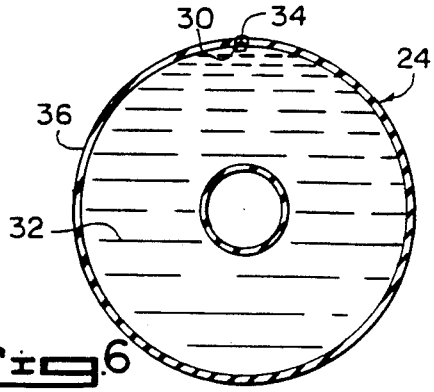
FIG. 6 is a cross sectional view of one of the water fillable weights taken alone line 6—6 in FIG. 1.
Figure 7:
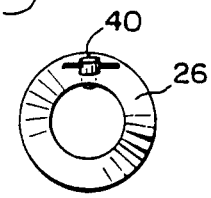
FIG. 7 is an end view of one of the collars.
Figure 8:
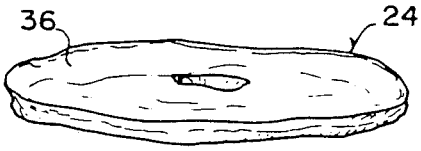
FIG. 8 is a perspective of one of the water fillable weights deflated.

A funnel 38 fits into each opening 30 in each water fillable weight 24. As shown in FIGS. 3 and 4, both bottled water **32*a* and tap water 32*b* can be poured into the funnel 38 to fill each water fillable weight 24. the elongated bar 12, the end plates 22 and the collars 26 are all fabricated out of a high-strength plastic material to reduce the total weight of the travel dumbbell 10. Each collar 26 further includes a set screw 40 to removably lock the collar 26 onto one end 16 of the elongated bar 12**.

Figure 11:
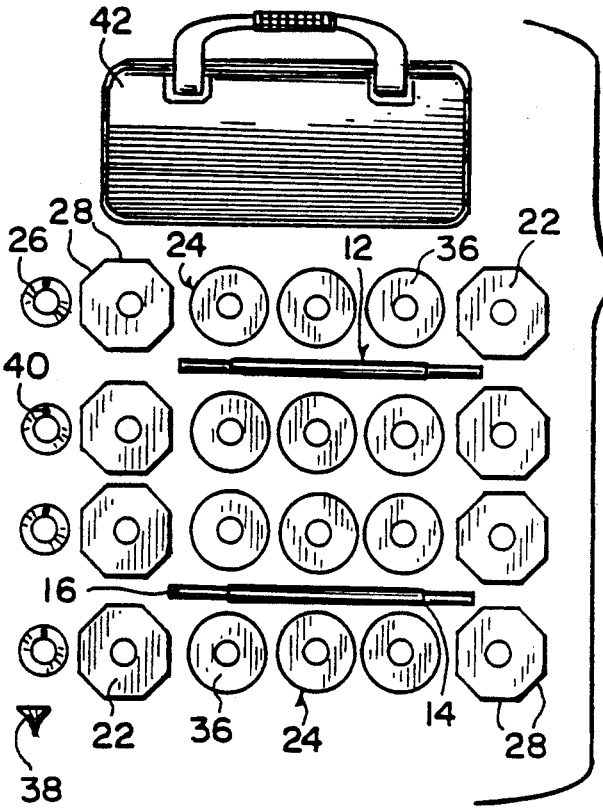
FIG. 11 is a disassembled elevational view of a typical travel dumbbell set.
Figure 9:
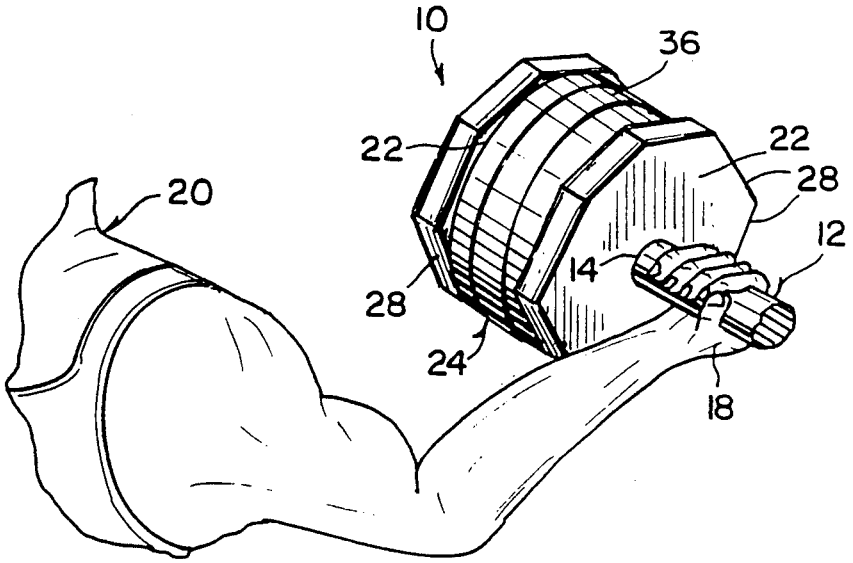
FIG. 9 is a perspective view of the invention with parts removed being used for an upper arm exercise.

As shown in FIG. 11, a carrying case 42 can be utilized to receive two disassembled travel dumbbells 10 and a funnel 38 therein, so as to be designed for a traveling body building person.

LIST OF REFERENCE NUMBERS

10 travel dumbbell
12 elongated bar
14 abutment on 12
16 end of 12
18 hand
20 user
22 end plate
24 water fillable weight
26 collar
28 flat edge on 22
29 floor
30 opening in 24
32 water

32a bottled water
32b tap water
34 closure plug
36 rubber donut shaped enclosure
38 funnel
40 set screw in 26
42 carrying case It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A travel dumbbell comprising:

(a) an elongated bar having two abutments, each spaced inwardly from one end thereof, said elongated bar to be gripped by at least one hand of a user;

(b) four end plates in which one is removably mounted on each end of said bar against one said abutment;

(c) a plurality of water fillable weights, in which at least one is removably mounted on each end of said bar against one said end plate so that a remaining said end plate is then removably mounted on each end of said bar in which said at least one water fillable weight will be positioned betweem said two end plates on each end of said bar for support and stabilization; and (d) two collars in which one is removably mounted on each end of said bar to retain said end plates and said at least one water fillable weight on each end of said bar.

2. A travel dumbbell as recited in claim 1, wherein each said end plate is slightly larger in diameter than each of said water fillable weights and further includes a plurality of flat edges around its periphery, whereby said flat edges will prevent said water fillable weights from rolling along a floor, such as, when the user is utilizing two said travel dumbbells for a push up exercise.

3. A travel dumbbell as recited in claim 2, wherein each said water fillable weight having an opening to receive water therein and a closure plug for sealing said opening so that the water can be added to said water fillable weight when being used and removed therefrom for storage and transport.

4. A travel dumbbell as recited in claim 3, wherein each said water fillable weight is fabricated out of a rubber donut shaped enclosure so that said enclosure can be collapsible when the water is removed therefrom.

5. A travel dumbbell as recited in claim 4, further including a funnel to fit into each said opening in each said water fillable weight so that bottled water and tap water can be poured into said funnel to fill each said water fillable weight.

6. A travel dumbbell as recited in claim 5, wherein said elongated bar, said end plates and said collars are all fabricated out of a high-strength plastic material to reduce the total weight of said travel dumbbell.

7. A travel dumbbell as recited in claim 6, wherein each said collar further includes a set screw to removably lock said collar onto one end of said elongated bar.

8. A travel dumbbell as recited in claim 7, further including a carrying case sized to receive at least one said disassembled travel dumbbell therein.

* * * * *